US008931575B2

(12) United States Patent
Okouchi

(10) Patent No.: US 8,931,575 B2
(45) Date of Patent: Jan. 13, 2015

(54) POWER TOOL

(75) Inventor: Katsumi Okouchi, Anjo (JP)

(73) Assignee: Makita Corporation, Anjo-shi (JP)

( * ) Notice: Subject to any disclaimer, the term of this patent is extended or adjusted under 35 U.S.C. 154(b) by 493 days.

(21) Appl. No.: 13/320,705

(22) PCT Filed: Apr. 6, 2010

(86) PCT No.: PCT/JP2010/056243
§ 371 (c)(1),
(2), (4) Date: Nov. 15, 2011

(87) PCT Pub. No.: WO2010/134392
PCT Pub. Date: Nov. 25, 2010

(65) Prior Publication Data

US 2012/0061115 A1 Mar. 15, 2012

(30) Foreign Application Priority Data

May 20, 2009 (JP) ..... 2009-122279

(51) Int. Cl.

| | |
|---|---|
| ***B27B 17/00*** | (2006.01) |
| ***B27B 17/14*** | (2006.01) |
| ***B25F 5/02*** | (2006.01) |
| ***G05G 1/08*** | (2006.01) |
| ***G05G 5/06*** | (2006.01) |

(52) U.S. Cl.
CPC . *B27B 17/14* (2013.01); *B25F 5/02* (2013.01); *G05G 1/082* (2013.01); *G05G 5/06* (2013.01)
USPC ..... 173/171; 227/8

(58) Field of Classification Search
CPC ..... B27B 17/00; B27B 17/02; B27B 17/04; B25D 11/00; B25D 11/04
USPC ..... 173/171, 170, 48; 30/381; 227/8; 81/16
See application file for complete search history.

(56) References Cited

U.S. PATENT DOCUMENTS

| | | | |
|---|---|---|---|
| 1,208,356 | A | 12/1916 | Nesbitt |
| 1,865,764 | A | 7/1932 | Keenon |
| 2,297,378 | A | 9/1942 | Wittenberg |

(Continued)

FOREIGN PATENT DOCUMENTS

| | | | |
|---|---|---|---|
| CN | 2071109 | U | 2/1991 |
| CN | 1640600 | A | 7/2005 |

(Continued)

OTHER PUBLICATIONS

Office Action dated Dec. 3, 2013 issued in Japanese Patent Application No. 2009-122281 (with English translation).

(Continued)

*Primary Examiner* — Thanh Truong
*Assistant Examiner* — Tara M Ho
(74) *Attorney, Agent, or Firm* — Oliff PLC

(57) ABSTRACT

A fixed operating knob is rotatably arranged on a chain saw body. The fixed operating knob comprises a knob body, a tab, a torsion spring, and a lock member. The knob body is rotatably attached to the chain saw body. The tab is attached to the knob body. The tab is attached so as to be capable of swinging between an operating position projecting from the knob body and a storing position stored in the knob body. The torsion spring biases the tab toward the operating position. When the tab moves to the storing position, the lock member retains the tab at the storing position against a biasing force of the torsion spring.

5 Claims, 12 Drawing Sheets

(56) References Cited

U.S. PATENT DOCUMENTS

| | | | | |
|---|---|---|---|---|
| 2,491,543 | A | 5/1948 | Alfonso | |
| 2,444,132 | A | 6/1948 | Gorden et al. | |
| 2,533,771 | A | 12/1950 | De Frees | |
| 3,143,441 | A | 8/1964 | Coleman et al. | |
| 3,194,284 | A | 7/1965 | Walker | |
| 3,557,986 | A | 1/1971 | Poole | |
| 3,621,876 | A | 11/1971 | Campbell | |
| 3,866,320 | A | 2/1975 | Progl | |
| 3,967,645 | A | 7/1976 | Gregory | |
| 4,165,816 | A | 8/1979 | Tupper | |
| 4,271,976 | A | 6/1981 | Detwiller | |
| 4,458,711 | A | 7/1984 | Flider | |
| 4,524,805 | A | 6/1985 | Hoffman | |
| 4,540,103 | A | 9/1985 | Kasugai et al. | |
| 4,747,501 | A | 5/1988 | Greaves | |
| 4,835,868 | A | 6/1989 | Nagashima | |
| 4,896,789 | A | 1/1990 | Federspiel | |
| 4,987,740 | A | 1/1991 | Coleman et al. | |
| 5,396,705 | A | 3/1995 | Leini | |
| 5,730,183 | A | 3/1998 | Kremsler | |
| 6,079,582 | A | 6/2000 | Nickel et al. | |
| 6,092,551 | A | 7/2000 | Bennett | |
| 6,237,228 | B1 | 5/2001 | Moody | |
| 6,585,005 | B1 | 7/2003 | Raftis et al. | |
| 6,619,497 | B2 | 9/2003 | Freiller | |
| 6,745,914 | B2 | 6/2004 | Hagano et al. | |
| 6,795,987 | B2 | 9/2004 | Cornwall | |
| 6,877,233 | B1 | 4/2005 | Franke | |
| 7,185,437 | B2 | 3/2007 | Behbahany | |
| 7,296,635 | B2 * | 11/2007 | Droste | 173/48 |
| 7,303,026 | B2 * | 12/2007 | Frauhammer et al. | 173/48 |
| 7,306,049 | B2 * | 12/2007 | Soika et al. | 173/49 |
| 7,481,000 | B2 | 1/2009 | Tynes et al. | |
| 8,233,818 | B2 | 7/2012 | Sasaki et al. | |
| 2004/0148788 | A1 | 8/2004 | Behbahany | |
| 2004/0222224 | A1 | 11/2004 | Plester | |
| 2005/0092156 | A1 * | 5/2005 | Michel et al. | 83/698.11 |
| 2006/0016081 | A1 | 1/2006 | Keeton et al. | |
| 2006/0075644 | A1 | 4/2006 | Keeton et al. | |
| 2006/0196058 | A1 | 9/2006 | Warfel et al. | |
| 2006/0207111 | A1 | 9/2006 | Sugishita | |
| 2006/0230900 | A1 | 10/2006 | Bergquisto | |
| 2009/0007439 | A1 | 1/2009 | Sugishita | |
| 2009/0119934 | A1 | 5/2009 | Sugishita | |
| 2009/0241353 | A1 | 10/2009 | Ericson et al. | |
| 2010/0088905 | A1 | 4/2010 | Pellenc | |
| 2010/0284710 | A1 | 11/2010 | Sasaki et al. | |
| 2010/0293797 | A1 | 11/2010 | Fisher et al. | |
| 2012/0012584 | A1 | 1/2012 | Chameroy et al. | |
| 2012/0061115 | A1 | 3/2012 | Okouchi | |

FOREIGN PATENT DOCUMENTS

| | | | |
|---|---|---|---|
| CN | 1724202 | A | 1/2006 |
| CN | 1756631 | A | 4/2006 |
| CN | 1791496 | A | 6/2006 |
| CN | 200977856 | Y | 11/2007 |
| DE | 19805821 | A1 | 8/1998 |
| DE | 103 53 737 | A1 | 6/2005 |
| DE | 20 2006 019 362 | U1 | 11/2007 |
| EP | 1619004 | A1 | 1/2005 |
| JP | A-50-32516 | | 3/1975 |
| JP | S-52-131870 | | 1/1977 |
| JP | U-55-163567 | | 11/1980 |
| JP | U-56-52653 | | 5/1981 |
| JP | U-58-192003 | | 12/1983 |
| JP | U-62-25180 | | 2/1987 |
| JP | U-1-69979 | | 5/1989 |
| JP | A-9-14475 | | 1/1997 |
| JP | B2-3135857 | | 2/2001 |
| JP | A-2005-199713 | | 7/2005 |
| JP | A-2006-27261 | | 2/2006 |
| JP | A-2006-103301 | | 4/2006 |
| JP | A-2006-138331 | | 6/2006 |
| JP | A-2006-238876 | | 9/2006 |
| WO | WO 2008122715 | A1 | 10/2008 |

OTHER PUBLICATIONS

Feb. 26, 2013 Office Action issued in Japanese Patent Application No. 2009-122280 (with translation).

Feb. 5, 2013 Office Action issued in Russian Patent Application No. 2011151825 (with translation).

Feb. 7, 2013 Office Action issued in Russian Patent Application No. 2011151828 (with translation).

Mar. 1, 2013 Office Action issued in U.S. Appl. No. 13/320,664.

Apr. 15, 2013 Notice of Allowance issued in U.S. Appl. No. 13/320,606.

Nov. 14, 2013 European Search Report issued in European Patent Application No. 10777627.0.

Apr. 30, 2013 Office Action issued in Japanese Application No. 2009-122281 (with translation).

Apr. 23, 2013 Office Action issued in Japanese Application No. 2009-122279 (with translation).

U.S. Appl No. 13/320,606, filed Nov. 15, 2011 in the name of Katsumi Okouchi.

U.S. Appl No. 13/320,664, filed Nov. 15, 2011 in the name of Katsumi Okouchi.

International Search Report issued in International Application No. PCT/JP2010/056243 dated Jun. 22, 2010 (with translation).

Written Opinion of the International Searching Authority issued in International Application No. PCT/JP2010/056243 dated Jun. 22, 2010 (with translation).

International Search Report issued in International Application No. PCT/JP2010/056244 dated Jul. 6, 2010 (with translation).

Written Opinion of the International Searching Authority issued in International Application No. PCT/JP2010/056244 dated Jul. 6, 2010 (with translation).

International Search Report issued in International Application No. PCT/JP2010/056245 dated Jun. 22, 2010 (with translation).

Written Opinion of the International Searching Authority issued in International Application No. PCT/JP2010/056245 Jun. 22, 2010 (with translation).

Aug. 14, 2013 Office Action issued in Chinese Patent Application No. CN201080032523.4 (with translation).

Sep. 30, 2013 Office Action issued in Chinese Patent Application No. CN201080032516.4 (with translation).

Oct. 29, 2013 Search Report issued in European Patent Application No. EP 10 77 7628.

Chinese Office Action issued in Chinese Patent Application No. 201080032513.0 dated Mar. 25, 2014 (w/ translation).

Chinese Office Action issued in Chinese Patent Application No. 201080032523.4 dated Apr. 1, 2014 (w/ translation).

* cited by examiner

POWER TOOL

TECHNICAL FIELD

The present specification discloses a power tool. In particular, the present specification discloses an art for enhancing operability of a rotation knob rotatably arranged on a power tool body and operated by a user.

BACKGROUND ART

Japanese Patent Application Laid-open No. 2006-103301 discloses a chain saw that is a type of power tool. According to the disclosure, the chain saw comprises a retaining assembly that is a type of a rotation knob rotatably arranged on a chain saw body. The rotation knob comprises a knob body and a tab attached to the knob body. The tab is arranged on the knob body so as to be capable of swinging between a storing position and an operating position. When the tab is at the operating position, the tab stands upright perpendicular to the knob body. An operator can hold the tab and rotatably operate the rotation knob by moving the tab from the storing position to the operating position. The tab is biased from the operating position toward the storing position by a torsion spring. In this configuration, when the operator releases a finger from the tab, the tab swings from the operating position to the storing position due to a biasing force of the torsion spring.

SUMMARY OF INVENTION

Technical Problem

With the rotation knob described above, when operating the tab, the tab is constantly biased from the operating position toward the storing position. Therefore, the tab becomes unstable at the operating position and operability of the rotation knob declines.

An art disclosed in the present application has been made in consideration of the problem described above and an object thereof is to enhance the operability of the rotation knob.

Solution to Technical Problem

An art disclosed in the present application is realized in a power tool. This power tool comprises a power tool body and a rotation knob rotatably arranged on the power tool body and operated by a user. The rotation knob comprises a knob body, a tab, a tab spring and a lock mechanism. The knob body is attached rotatably on the power tool body. The tab is attached on the knob body. The tab is supported being capable of swinging between an operating position projecting from the knob body and a storing position stored in one of the knob body and the power tool body. The tab spring biases the tab toward the operating position. The lock mechanism holds the tab at the storing position against the pressure of the tab spring in a case where the tab moves to the storing position.

With this rotation knob, in a case where the rotation knob is not operated, the tab may be retained at the storing position. When rotatably operating the rotation knob, by releasing locking that comprises the lock mechanism, the tab automatically moves from the storing position to the operating position due to a biasing force of the tab spring. The user may hold the tab and operate the rotation knob. At this point, the tab is maintained at the operating position by the biasing force of the tab spring. The tab is stabilized at the operating position. Consequently, the user may easily hold the tab and operate the rotation knob. Due to the above, according to the configuration described above, operability of the rotation knob may be enhanced.

For example, the lock mechanism may be configured so that in a case where the tab is at the storing position, the lock mechanism engages the tab to retain the tab at the storing position. Alternatively, the lock mechanism may be configured so that in the case where the tab is at the storing position, a magnetic force in an opposite direction to the biasing force of the tab spring retains the tab at the storing position.

The lock mechanism may comprise a lock member arranged on one of the knob body and the tab. The lock member may be movably arranged between a lock position engaging with another of the knob body and the tab and an unlock position disengaging the other of the knob body and the tab in a state where the tab is located at the storing position.

According to this configuration, when the lock member is moved from the lock position to the unlock position in a state where the tab is retained at the storing position, the tab automatically moves from the storing position to the operating position. The user need not perform troublesome operations when moving the tab to the operating position.

In this case, the lock mechanism may further comprise a lock spring biasing the lock member toward the lock position.

When the tab swings to the storing position and the lock member is capable of moving to the lock position, a surface of the tab may oppose a surface of one of the knob body or the power tool body with a clearance. The clearance may become gradually larger as a distance from a swinging axis of the tab increases.

According to this configuration, when swinging the tab from the operating position toward the storing position, the tab may be swung past a position where an engagement by the lock member occurs. As a result, even if a certain amount of deformation occurs on the lock member and the like, the lock member may be reliably engaged with the knob body and the tab.

The power tool may further comprise a ring member fixed on the power tool body and surrounding the tab and the knob body. In this case, a plurality of projecting portions may be disposed on the ring member along a circumferential direction thereof, on at least one of an end surface located opposite from the power tool body and an inner surface. The tab may comprise an engaging portion that engages with at least one of the plurality of projecting portions when the tab is positioned at the storing position.

According to this configuration, in a case where the tab is at the storing position, the rotation knob may be prevented from rotating relative to a device.

Advantageous Effects of Invention

According to the art disclosed in the present specification, the tab may be stabilized at the operating position. As a result, the operability of the rotation knob may be enhanced.

DESCRIPTION OF EMBODIMENT

Preferred Aspects of Invention

Preferred aspects of below embodiment will be listed.

(1) The rotation knob described above is favorably used in an oil cap of a chain saw. The chain saw comprises a chain saw body, a guide bar, a saw chain, an oil tank, and the oil cap. The guide bar is attached to the chain saw body so as to be capable of moving reciprocally relative to the chain saw body. The oil tank reserves lubricating oil that is supplied to the saw chain and the guide bar. The oil cap is rotatably arranged on the oil tank and closes an opening of the oil tank.

(2) The rotation knob described above is favorably used in a fixed operating knob that fixes the guide bar to the chain saw body. The fixed operating knob is rotatably arranged on the chain saw body.

(3) A swinging axis of the tab orthogonally intersects a center of rotation of the rotation knob.

(4) When the tab swings from a storing position to an operating position, the tab comes into contact with a knob body and swinging of the tab is thereby stopped.

Embodiment

Figure 1:
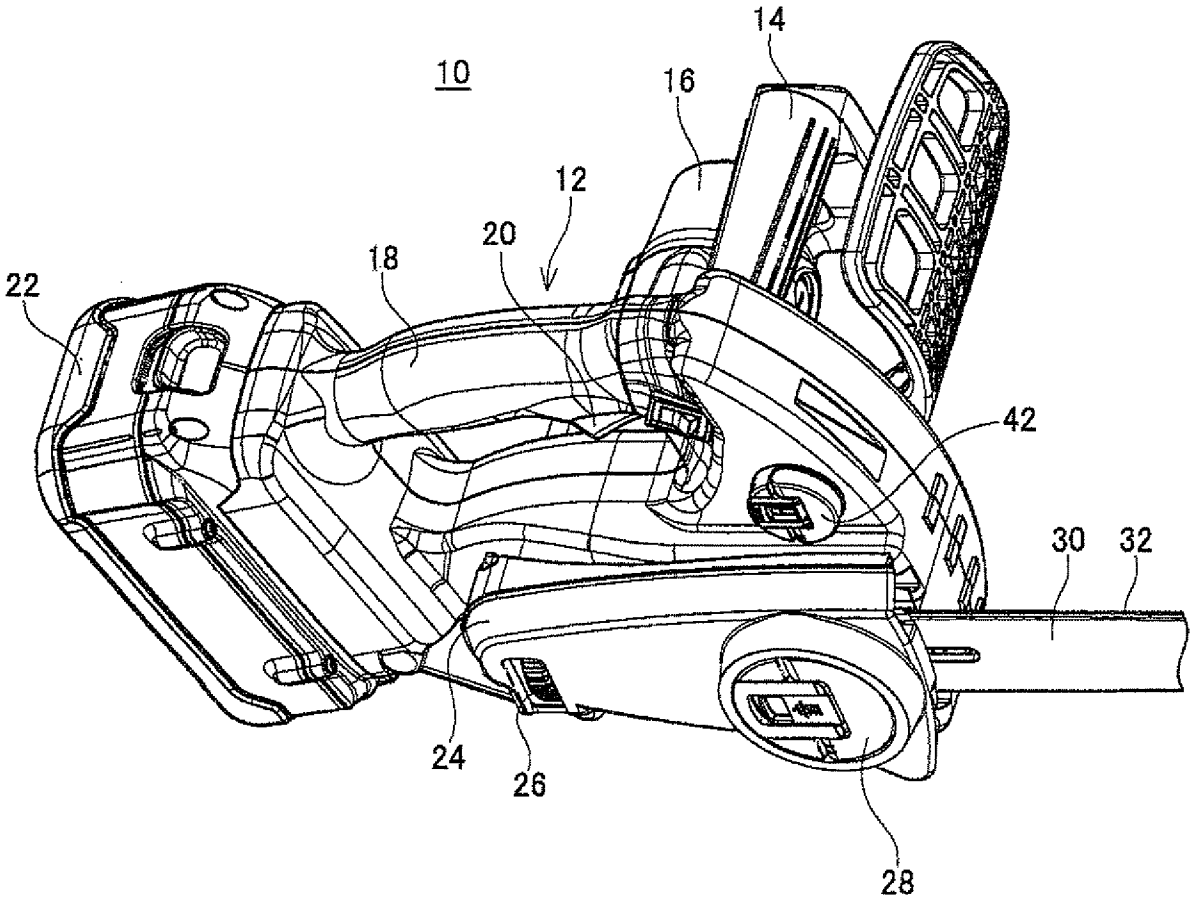
FIG. 1 shows an external view of a chain saw.
Figure 2:
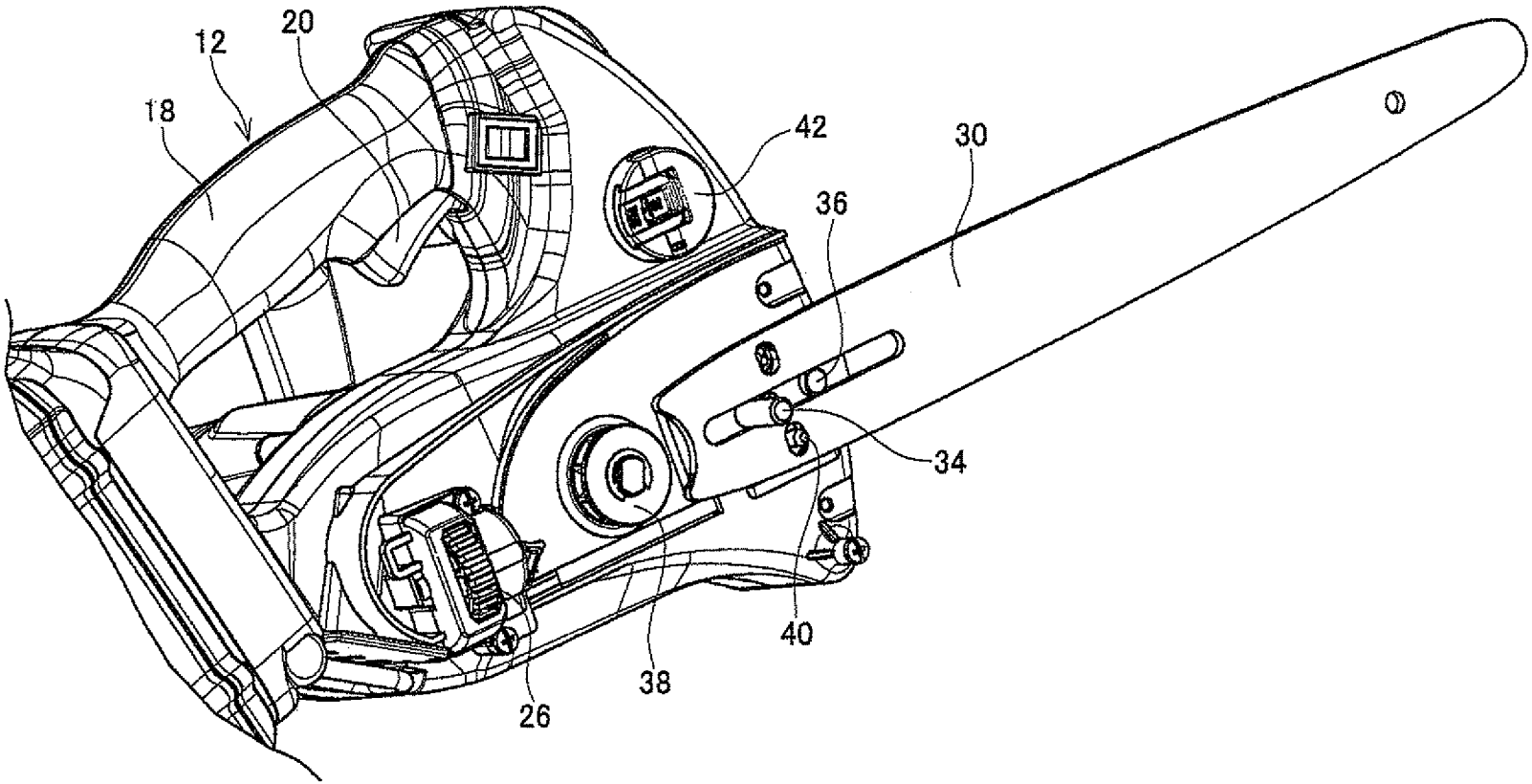
FIG. 2 shows an external view of a part of the chain saw.

An embodiment will now be described with reference to the drawings. FIG. 1 shows an external view of a chain saw 10. FIG. 2 shows an external view of the chain saw 10 in a state in which a cover 24 and a saw chain 32 have been removed from a body 12 which will be described later. The chain saw 10 comprises the body 12, a guide bar 30 attached to the body 12, and the saw chain 32.

As shown in FIGS. 1 and 2, the body 12 comprises a motor 16, a first grip 14, a second grip 18, and a sprocket 38. A trigger switch 20 that activates the chain saw 10 is arranged on the second grip 18. The sprocket 38 is arranged on a side surface of the body 12 and is rotatably supported by the body 12. The sprocket 38 is connected to the motor 16 and is rotatably driven by the motor 16. The motor 16 is configured so that power is supplied to the motor 16 from a battery 22 in conjunction with an operation performed on the trigger switch 20. The battery 22 is detachably attached to the body 12.

An oil tank, not shown, is arranged on the body 12. The oil tank stores lubricating oil to be supplied to the saw chain 32, the sprocket 38, and the like. An opening 12*a* (refer to FIG. 5) of the oil tank is closed by an oil cap 42, which will be described in detail later. The oil cap 42 is rotatably attached to the body 12.

The guide bar 30 is attached to the body 12. The guide bar 30 is arranged adjacent to the sprocket 38. The guide bar 30 is supported against the body 12 by a supporting bolt 34 and a supporting pin 36. The supporting bolt 34 and the supporting pin 36 are fixed to the body 12 and support the guide bar 30 so that the guide bar 30 is capable of moving reciprocally relative to the body 12. In other words, the guide bar 30 is arranged capable of approaching/retracting from the sprocket 38. The saw chain 32, not shown in FIG. 2, is provided with tension between the sprocket 38 and the guide bar 30. When an operator operates a wheel 26, an adjusting pin 40 that engages with the guide bar 30 moves along a rotating shaft, not shown. Consequently, the operator can cause the guide bar 30 to approach/retract from the sprocket 38 and adjust the tension of the saw chain 32.

A cover 24 that covers the sprocket 38 and a fixed operating knob 28 that is a rotation knob for fixing the guide bar 30 are arranged on a side surface of the body 12. The fixed operating knob 28 is rotatably attached to the body 12. The fixed operating knob 28 is screwed onto the supporting bolt 34 that projects from a side surface of the body 12. When the fixed operating knob 28 is tightened relative to the supporting bolt 34, the guide bar 30 becomes fixed to the body 12, and when the fixed operating knob 28 is loosened relative to the supporting bolt 34, the guide bar 30 becomes capable of moving reciprocally relative to the body 12. The cover 24 is fixed by the fixed operating knob 28. The cover 24 can be detached from the body 12 by detaching the fixed operating knob 28 from the supporting bolt 34.

Next, operations of the chain saw 10 will be described. When the operator turns on the trigger switch 20, the motor 16 that is a power source rotates. Due to a rotation of the motor 16, the sprocket 38 is rotationally driven relative to the body 12. Consequently, the saw chain 32 that is a tool rotates along the sprocket 38 and the guide bar 30.

Figure 3:
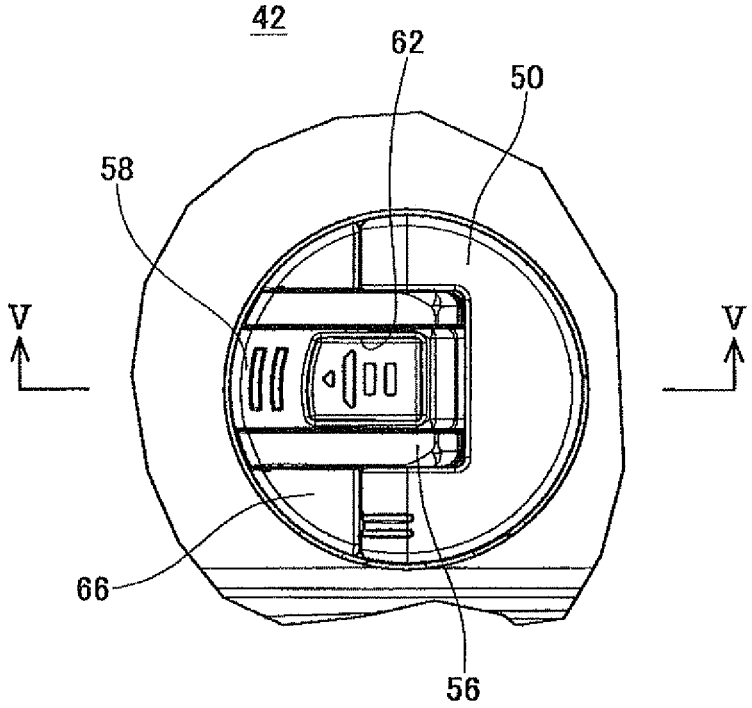
FIG. 3 shows an enlarged view of an oil cap.
Figure 4:
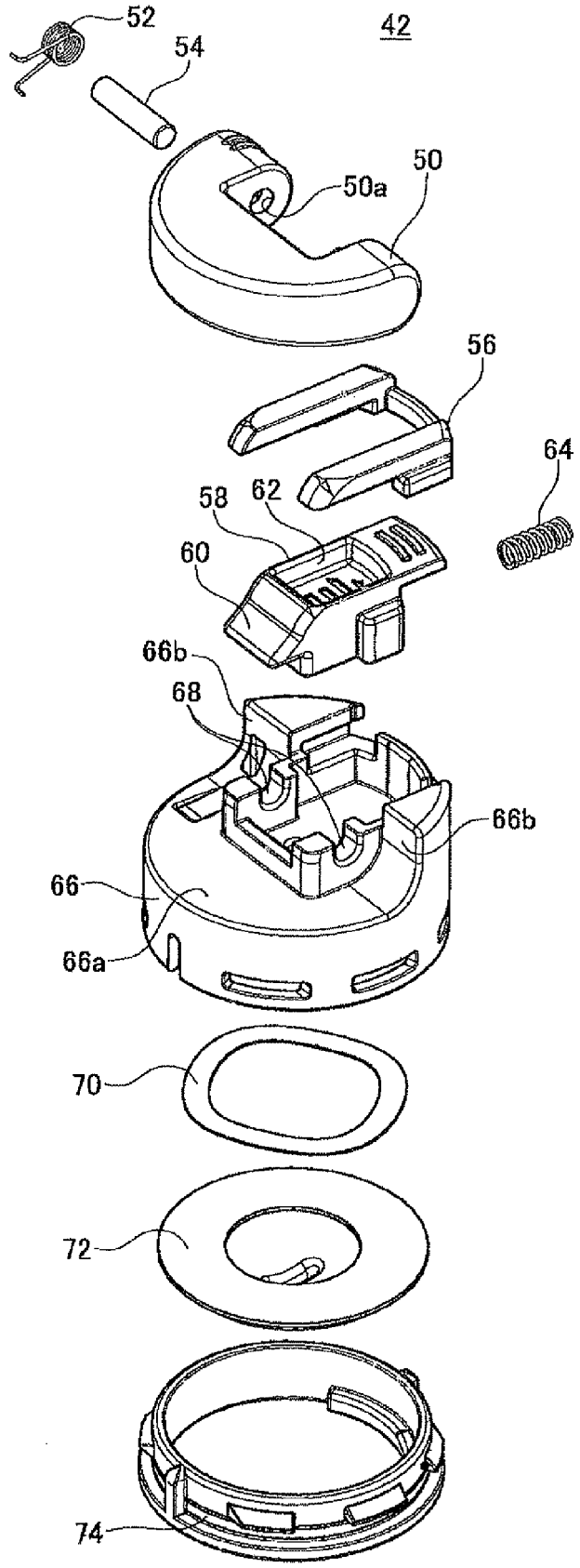
FIG. 4 shows an exploded perspective view of the oil cap.
Figure 5:
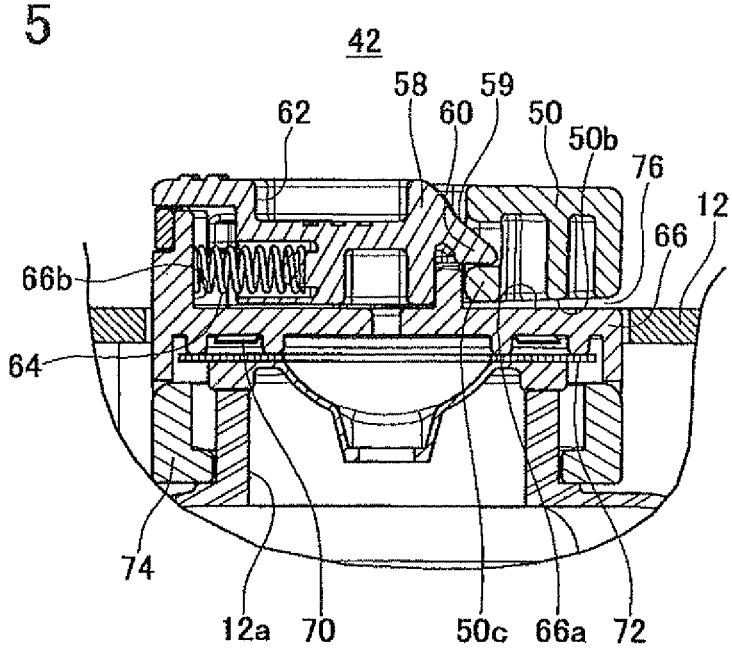
FIG. 5 shows a cross-sectional view of a V-V cross section of FIG. 3.
Figure 6:
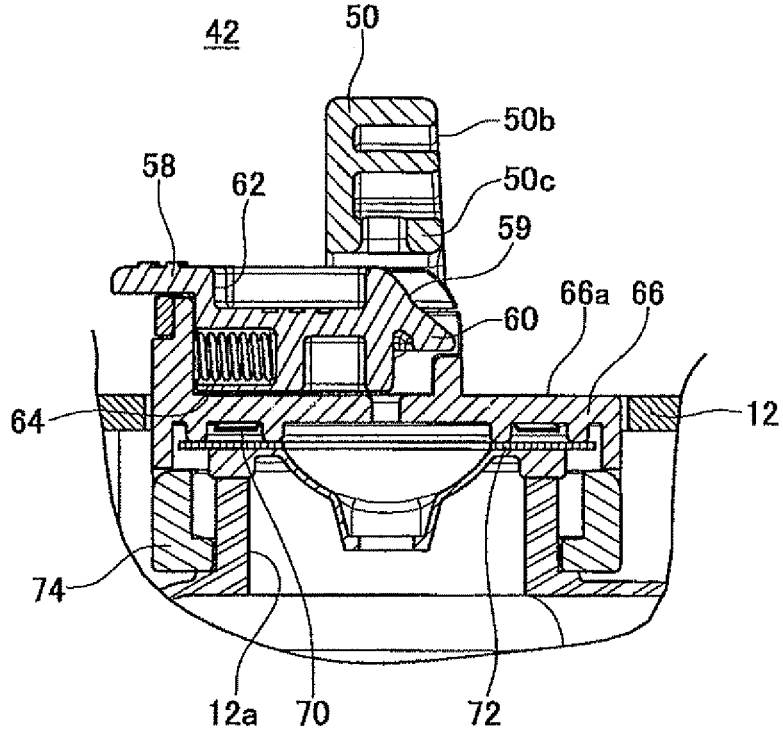
FIG. 6 shows a cross-sectional view of a state in which a tab is at an operating position.

Next, a configuration of the oil cap 42 will be described. FIG. 3 shows an enlarged view of the oil cap 42. FIG. 4 shows an exploded perspective view of the oil cap 42. FIG. 5 shows a cross-sectional view of a V-V cross section of FIG. 3. The oil cap 42 comprises a knob body 66, a tab 50, a lock member 58, and the like. FIGS. 3 to 5 show a state in which the tab 50 is at a storing position. FIG. 6 shows a state in which the tab 50 is at an operating position on a same cross section as in FIG. 5. The knob body 66 is rotatably attached relative to the body 12. Washers 70 and 72 are attached to the knob body 66 on a side of the opening 12*a* of the oil tank. The washers 70 and 72 are sandwiched between the knob body 66 and a ring-like cap 74. The knob body 66 has an opposing surface 66*a* that opposes a side surface 50*b* of the tab 50 on a side of the knob body 66 when the tab 50 is at the storing position, which will be described later, and a contacting surface 66*b* that comes into contact with the tab 50 when the tab 50 is at the operating position, which will be described later.

The tab 50 is attached to the knob body 66 and is capable of swinging. An opening 50*a* is formed at a center of swinging of the tab 50. A swinging shaft (axis) 54 is inserted through the opening 50*a*. The swinging shaft 54 is arranged at a position at which the swinging shaft 54 orthogonally intersects a center axis of rotation of the oil cap 42. The swinging shaft 54 is inserted through a torsion spring 52. The torsion spring 52 biases the tab 50 from the storing position toward the operating position. A clearance 76 is provided between the side surface 50*b* of the tab 50 on the side of the knob body 66 and the opposing surface 66*a* when the tab 50 is at a position where the tab 50 is locked by the lock member 58. The clearance 76 gradually becomes greater as a distance from the swinging shaft 54 of the tab 50 becomes greater.

The tab 50 is locked to the storing position by the lock member 58. The lock member 58 is slidably attached to the knob body 66. The lock member 58 is slidably arranged relative to the knob body 66 between a lock position that locks the tab 50 to the storing position as shown in FIGS. 3 and 5 and an unlock position that disengages the locking of the tab 50 as shown in FIG. 6. The lock member 58 is biased to the lock position by a spring 64. The lock member 58 slides along a fixed guide member 56 of the knob body 66. The lock member 58 has an engaging portion 60 that engages with an engaging portion 50*c* of the tab 50 when the tab 50 is at the storing position. An inclined surface 59 (an upper surface 59 in FIG. 5) of the engaging portion 60 is inclined toward the knob body 66.

The tab 50 is locked at the storing position by engaging with the engaging portion 60 of the lock member 58 at the lock position. The operator hooks a depressed part 62 of the lock member 58 with a finger to move the lock member 58 from the lock position to the unlock position shown in FIG. 6. When the lock member 58 is moved to the unlock position, the tab 50 swings toward the operating position due to a biasing force of the torsion spring 52. Swinging of the tab 50 is restricted as the tab 50 comes into contact with the contacting surface 66*b* of the knob body 66. When the operator releases the lock member 58, the lock member 58 moves from the unlock position to the lock position due to a biasing force of the spring 64. When the tab 50 is at the operating position, the tab 50 projects from the knob body 66. Consequently, the operator can hold the tab 50 and rotationally move the oil cap 42 relative to the body 12.

When the tab 50 is pressed from the operating position toward the storing position, the tab 50 swings relative to the knob body 66. As the tab 50 moves from the operating position to the storing position, the inclined surface 59 of the lock member 58 is pressed by the engaging portion 50*c* of the tab 50 and the lock member 58 is gradually moved toward the unlock position. When the tab 50 moves to the storing position, the contact between the inclined surface 59 of the lock member 58 and the engaging portion 50*c* is released. In other words, the lock member 58 is released from a pressing force from the tab 50. As a result, the lock member 58 is moved to the lock position by a biasing force of the spring 64. The tab 50 goes beyond a position at which the tab 50 is locked by the lock member 58 (a position of the tab 50 in FIG. 5) and moves until the side surface 50*b* of the tab 50 comes into contact with the opposing surface 66*a* of the knob body 66. When the operator releases the finger from the tab 50, the tab 50 is moved by a biasing force of the torsion spring 52 to a position at which the tab 50 engages with the lock member 58 as shown in FIG. 5. The tab 50 engages with, and is locked by, the lock member 58.

Figure 7:
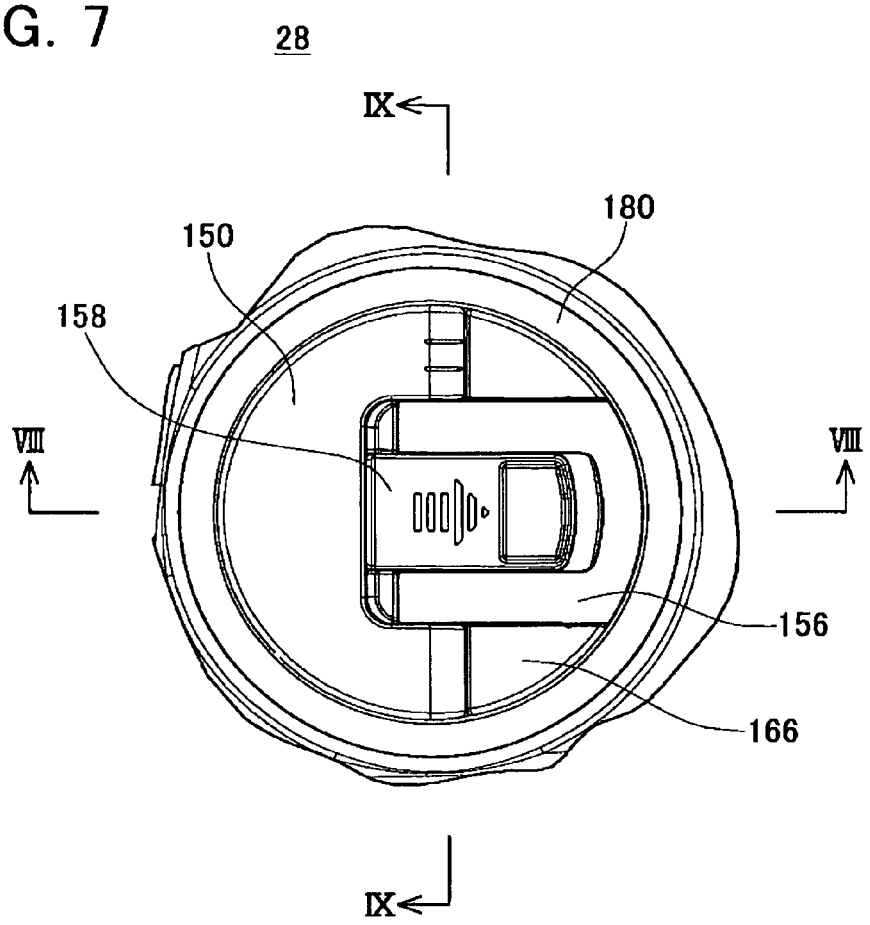
FIG. 7 shows an enlarged view of a fixed operating knob.
Figure 8:
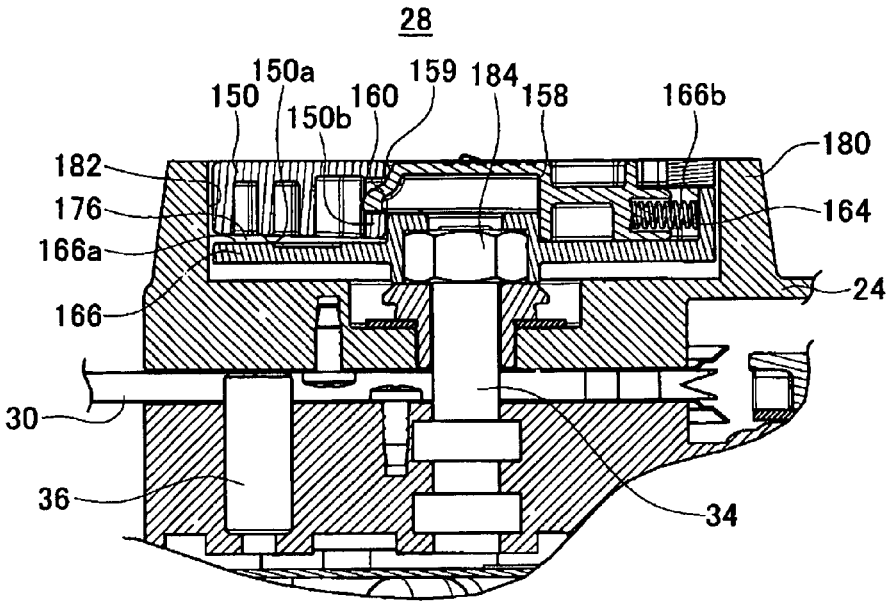
FIG. 8 shows a cross-sectional view of a VIII-VIII cross section of FIG. 7.
Figure 9:
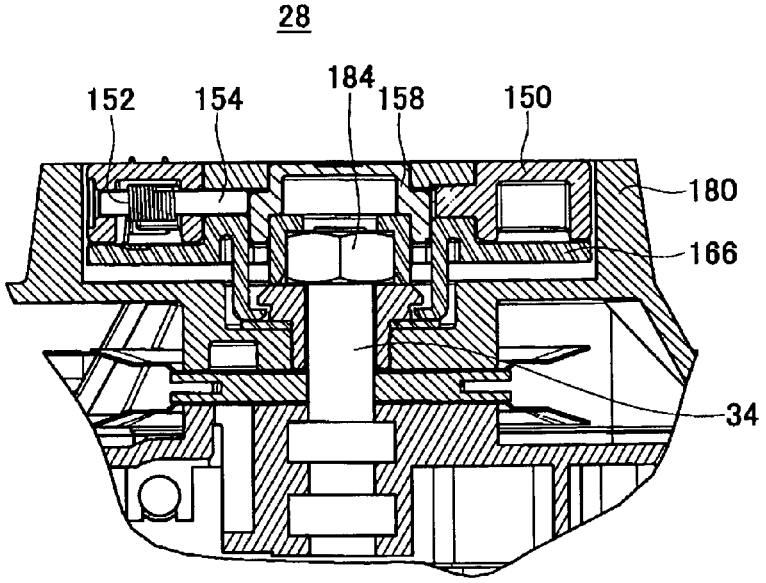
FIG. 9 shows a cross-sectional view of a IX-IX cross section of FIG. 7.

Next, a configuration of the fixed operating knob 28 will be described. FIG. 7 shows an enlarged view of the fixed operating knob 28. FIG. 8 shows a cross-sectional view of a VIII-VIII cross section of FIG. 7. FIG. 9 shows a cross-sectional view of a IX-IX cross section of FIG. 7. The fixed operating knob 28 comprises a knob body 166, a tab 150, a lock member 158, a ring member 180, a nut 184, and the like. FIGS. 7 to 9 show a state in which the tab 150 is at the storing position. The knob body 166 has an opposing surface 166*a* that opposes a side surface 150*a* of the tab 150 on a side of the knob body when the tab 150 is at the storing position and a contacting surface (not shown) that comes into contact with the tab 150 when the tab 150 is at the operating position, which will be described later. The fixed operating knob 28 is attached to the body 12 by screwing the nut 184 into the supporting bolt 34.

The tab 150 is attached to the knob body 166 via a swinging shaft (axis) 154 and is capable of swinging. The swinging shaft 154 is arranged at a position at which the swinging shaft 154 orthogonally intersects a center axis of rotation of the fixed operating knob 28 or, in other words, a position at which the swinging shaft 154 orthogonally intersects an axial direction of the supporting bolt 34. The swinging shaft 154 is inserted through a torsion spring 152. The torsion spring 152 biases the tab 150 from the storing position toward the operating position. A clearance 176 is provided between the side surface 150*a* of the tab 150 on the side of the knob body 166 and the opposing surface 166*a* when the tab 150 is at a position where the tab 150 is locked by the lock member 158. The clearance 176 gradually becomes greater as a distance from the swinging shaft 154 of the tab 150 becomes greater.

The tab 150 is locked to the storing position by the lock member 158. The lock member 158 is slidably attached to the knob body 166. The lock member 158 is slidably arranged between a lock position that locks the tab 150 to the storing position as shown in FIGS. 7 and 8 and an unlock position (refer to FIG. 10) that disengages the locking of the tab 150. The lock member 158 is biased to the lock position by a spring 164. The lock member 158 slides along a fixed guide member 156 of the knob body 166. The lock member 158 has an engaging portion 160 that engages with an engaging portion 150*b* of the tab 150 when the tab 150 is at the storing position. An inclined surface 159 (an upper surface 159 in FIG. 8) of the engaging portion 160 is inclined toward the knob body 166.

Figure 10:
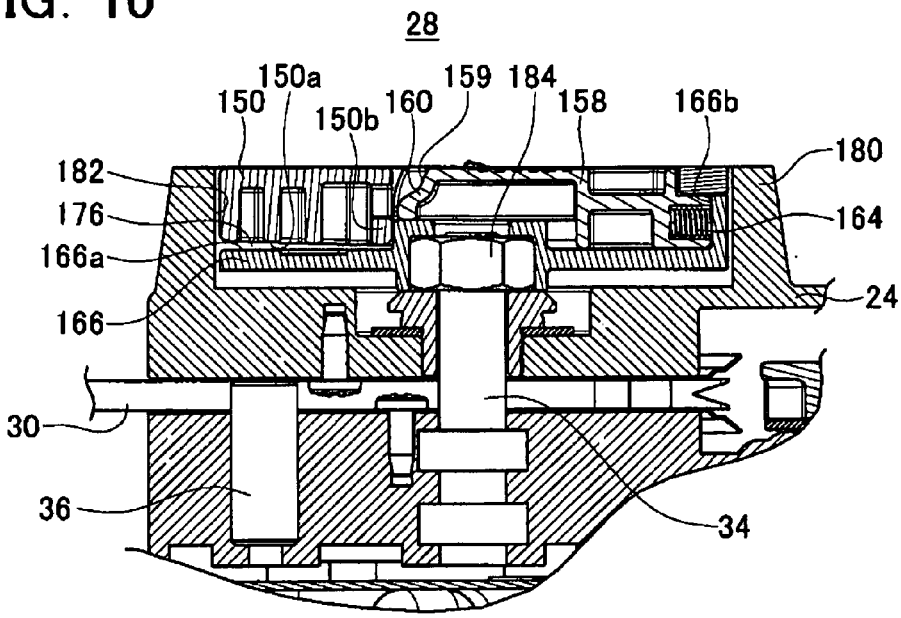
FIG. 10 shows a state in which a lock member has moved to an unlock position.
Figure 11:
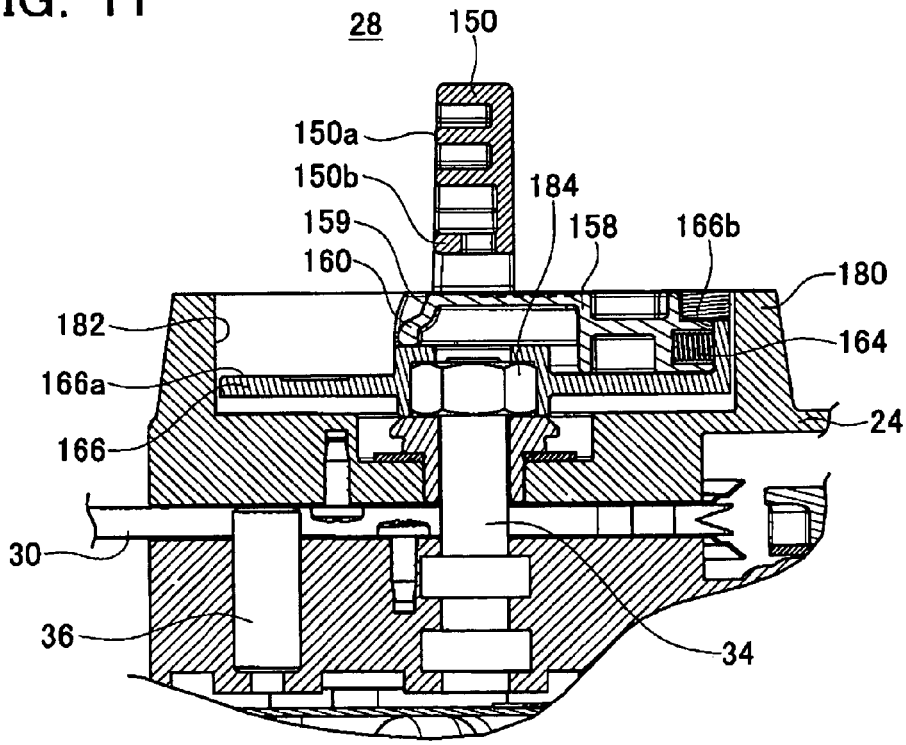
FIG. 11 shows a state in which the tab is at the operating position.

FIG. 10 shows a state in which the lock member 158 has moved to an unlock position on the VIII-VIII cross section of FIG. 7. When the lock member 158 is moved to the unlock position, the engagement between the tab 150 and the lock member 158 is released. As a result, the tab 150 swings toward the operating position due to a biasing force of the torsion spring 152. Swinging of the tab 150 is restricted as the tab 150 comes into contact with the contacting surface of the knob body 166. FIG. 11 shows a state in which the tab 150 is at the operating position. When the tab 150 is at the operating position, the tab 150 projects from the knob body 166. Consequently, the operator can hold the tab 150 and rotationally move the fixed operating knob 28 relative to the body 12. The lock member 158 is moved from the unlock position to the lock position by a biasing force of the spring 164.

Figure 12:
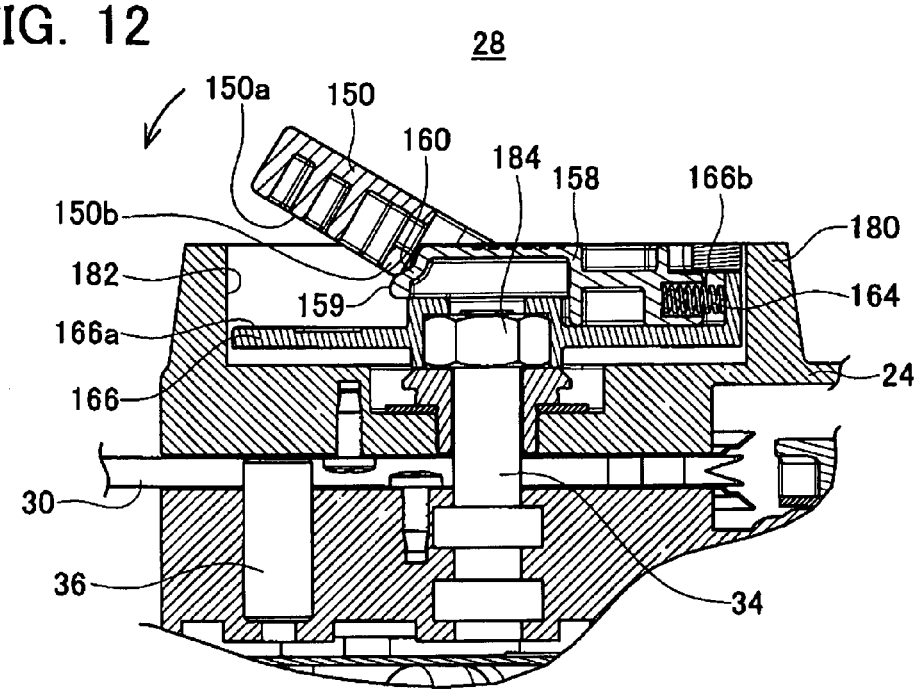
FIG. 12 shows a state in which the tab is halfway from the operating position to a storing position.
Figure 13:
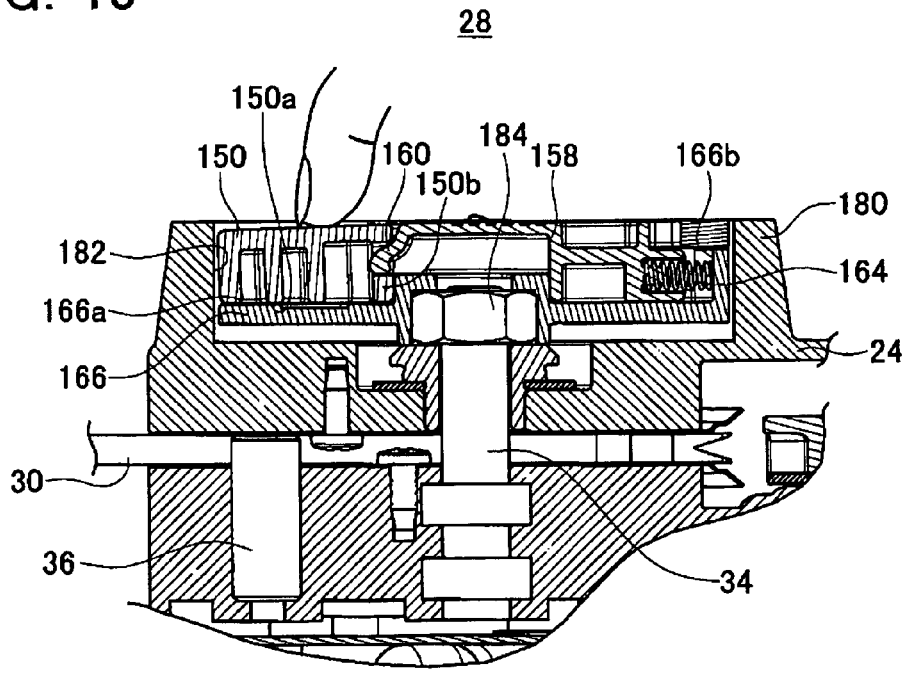
FIG. 13 shows a state in which the tab is in contact with a knob body at the storing position.

When the tab 150 is pressed from the operating position toward the storing position, the tab 150 swings relative to the knob body 166. As shown in FIG. 12, as the tab 150 moves from the operating position to the storing position, the inclined surface 159 of the lock member 158 is pressed by the engaging portion 150*b* of the tab 150 and the lock member 158 is gradually moved toward the unlock position. When the tab 150 moves to the storing position, the contact between the inclined surface 159 of the lock member 158 and the engaging portion 150*b* is released. In other words, the lock member 158 is released from a pressing force from the tab 150. As a result, the lock member 158 is moved to the lock position by a biasing force of the spring 164. As shown in FIG. 13, the tab 150 goes beyond a position at which the tab 150 is locked by the lock member 158 (a position of the tab 150 in FIG. 8) and moves until the side surface 150*a* of the tab 150 comes into contact with the opposing surface 166*a* of the knob body 166. When the operator releases the tab 150, the tab 150 is moved by a biasing force of the torsion spring 152 to a position at which the tab 150 engages with the lock member 158 as shown in FIG. 8. The tab 150 engages with, and is locked by, the lock member 158.

With the fixed operating knob 28 according to the present embodiment, locking of the tab 150 is released by moving the lock member 158 from the lock position to the unlock position. Accordingly, the tab 150 is moved from the storing position to the operating position by the biasing force of the torsion spring 152.

When the tab 150 is at the operating position, the tab 150 is brought into contact with the knob body 166 by the biasing force of the torsion spring 152. As a result, the tab 150 stabilizes at the operating position. Accordingly, operability of the tab 150 is enhanced.

Similarly, with the oil cap 42, locking of the tab 50 is released by moving the lock member 58 from the lock position to the unlock position and the tab 50 is moved from the storing position to the operating position. When the tab 50 is at the operating position, the tab 50 is brought into contact with the knob body 66 by the biasing force of the torsion spring 52. As a result, the tab 50 stabilizes at the operating position. Accordingly, operability of the tab 50 is enhanced.

The lock member 158 is biased from the unlock position toward the lock position by the spring 164. As the tab 150 swings from the operating position toward the storing position, the tab 150 comes into contact with the lock member 158 and moves the lock member 158 from the lock position to the unlock position. When the tab 150 is moved to the storing position, the lock member 158 is moved from the unlock position to the lock position by a biasing force of the spring 164. As a result, when storing the tab 150 into the storing position, the tab 150 is automatically locked at the storing position without having to operate the lock member 158 and simply by moving the tab 150 from the operating position to the storing position.

Similarly, with the oil cap 42, when the tab 50 swings from the operating position to the storing position, the lock member 58 is moved from the lock position to the unlock position. When the tab 50 is moved to the storing position, the lock member 58 is moved from the unlock position to the lock position by the biasing force of the spring 64. As a result, when storing the tab 50 into the storing position, the tab 50 is automatically locked at the storing position without having to operate the lock member 58 and simply by moving the tab 50 from the operating position to the storing position.

With the fixed operating knob 28, a clearance 176 is provided between the side surface 150*a* of the tab 150 and the opposing surface 166*a* of the knob body 166 when the tab 150 is at the position where the tab 150 is locked by the lock member 158. In this configuration, when the tab 150 swings from the operating position to the storing position, the tab 150 goes beyond the position at which the tab 150 is locked by the lock member 158 and swings to a position at which the tab 150 comes into contact with the opposing surface 166*a*. Accordingly, as the lock member 158 moves from the unlock position to the lock position, a clearance can be formed between the engaging portion 160 of the lock member 158 and the engaging portion 150*b* of the tab 150. Therefore, the engaging portion 160 and the engaging portion 150*b* need no longer be fabricated with high precision.

(Modifications)

Modifications of the fixed operating knob 28 according to the embodiment above will now be described with reference to the drawings.

Figure 14:
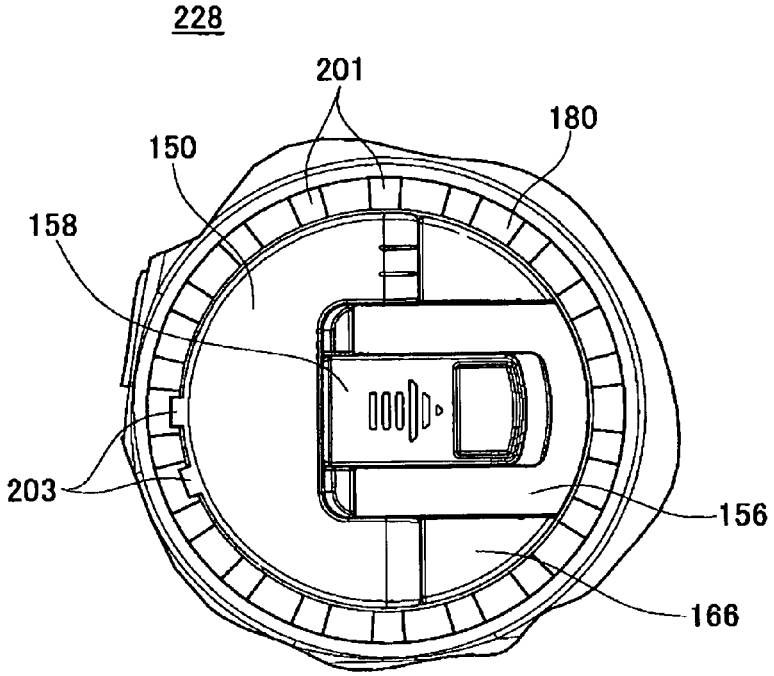
FIG. 14 shows a fixed operating knob according to a first modification.

FIG. 14 shows a fixed operating knob 228 of a first modification. In FIG. 14 and hereinafter, components similar to those of the fixed operating knob 28 will be denoted by similar reference characters to the embodiment described above and redundant descriptions thereof will be omitted.

A plurality of projecting portions 201 is formed on an upper surface of a ring member 180 of the fixed operating knob 228 or, in other words, on an end surface of the ring member 180 positioned on an opposite side to the body 12. The projecting portions 201 are arranged at regular intervals along a circumferential direction of the ring member 180. The upper ends of the projecting portions 201 are positioned on a same plane as an upper end surface of the tab 150 when the tab 150 is at a position where the tab 150 is locked by the lock member 158. An engaging portion 203 that engages with the projecting portions 201 is formed on the tab 150. The engaging portion 203 projects from the tab 150 toward the ring member 180.

With the fixed operating knob 228, when the tab 150 is at a storing position, an engagement between the projecting portions 201 of the ring member 180 and the engaging portion 203 of the tab 150 can prevent the tab 150 from rotating relative to the ring member 180. Accordingly, wobbling of the guide bar 30 due to relaxing of a binding force between a nut 184 of the fixed operating knob 228 and the supporting bolt 34 of the body 12 can be prevented.

Figure 15:
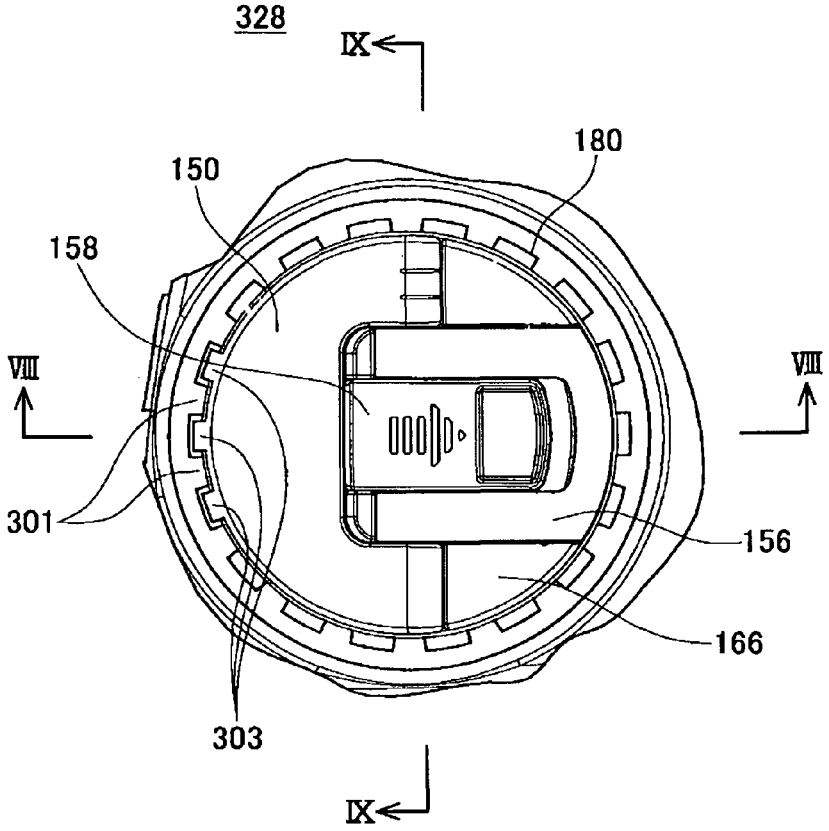
FIG. 15 shows a fixed operating knob according to a second modification.

FIG. 15 shows a fixed operating knob 328 of a second modification. In FIG. 15 and hereinafter, components similar to those of the fixed operating knob 28 will be denoted by similar reference characters to the embodiment described above and redundant descriptions thereof will be omitted.

A plurality of projecting portions 301 is formed on an inner surface of the ring member 180 of the fixed operating knob 328. The projecting portions 301 are arranged at regular intervals along a circumferential direction of the ring member 180. An engaging portion 303 that engages with the projecting portions 301 is formed on the tab 150. The engaging portion 303 projects from the tab 150 toward the ring member 180.

With the fixed operating knob 328, in the same manner as the fixed operating knob 228, when the tab 150 is at a storing position, an engagement between the projecting portions 301 of the ring member 180 and the engaging portion 303 of the tab 150 can prevent the tab 150 from rotating relative to the ring member 180.

Figure 16:
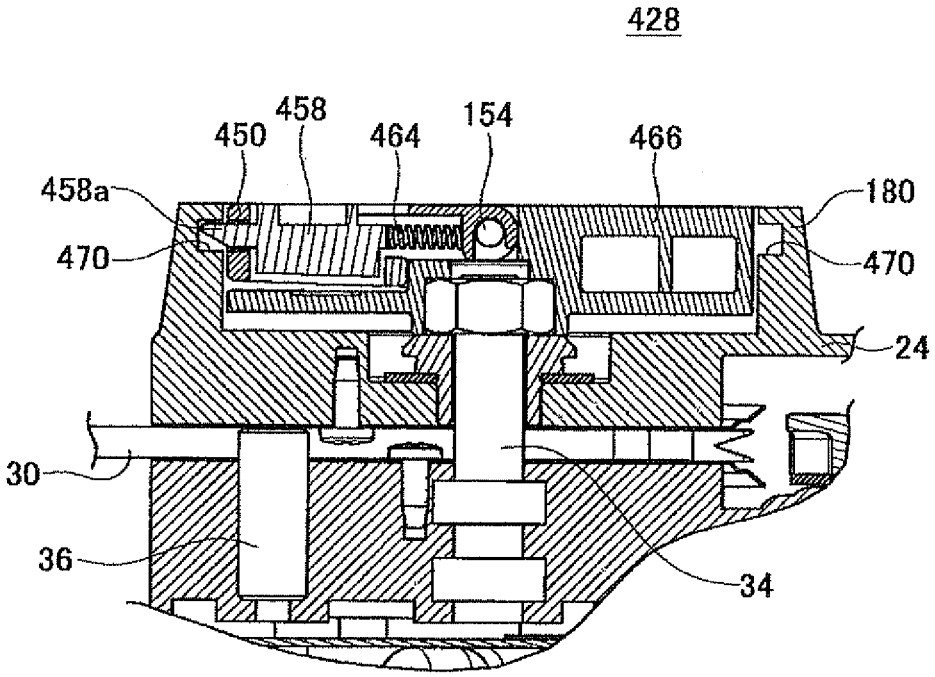
FIG. 16 shows a fixed operating knob according to a third modification.

FIG. 16 shows a longitudinal sectional view of a fixed operating knob 428 of a third modification. In FIG. 15 and hereinafter, components similar to those of the fixed operating knob 28 will be denoted by similar reference characters to the embodiment described above and redundant descriptions thereof will be omitted.

The fixed operating knob 428 comprises a knob body 466, a tab 450, a lock member 458, a ring member 180, and the like. FIG. 16 shows a state in which the tab 450 is at a storing position.

The tab 450 is attached to the knob body 166 via a swinging shaft 154 so as to be capable of swinging. The swinging shaft 154 is inserted through a torsion spring 152. The torsion spring 152 biases the tab 450 from the storing position toward an operating position.

The tab 450 comprises a lock member 458. The lock member 458 is slidably arranged relative to the tab 450 between a lock position at which the lock member 458 engages with a depressed part 470 of the ring member 180 to lock the tab 450 to the storing position and an unlock position that disengages the locking of the tab 450. The lock member 458 is biased to the lock position by a spring 464.

The lock member 458 comprises an engaging portion 458*a* that engages with the depressed part 470 of the ring member 180. The engaging portion 458*a* is inclined toward an outer side of the tab 450 along a direction oriented from the storing position toward the operating position. The plurality of depressed parts 470 that engages the lock member 458 is formed on an inner surface of the ring member 180. The depressed parts 470 are arranged at regular intervals along a circumferential direction of the ring member 180.

When the lock member 458 is moved from the lock position to the unlock position, the tab 450 swings from the storing position to the operating position due to the biasing force of the torsion spring 152. At this point, the lock member 458 is moved from the unlock position to the lock position by a biasing force of the spring 464. As the tab 450 is moved from the operating position toward the storing position, the engaging portion 458*a* of the lock member 458 comes into contact with an upper end (an upper end shown in FIG. 16) of the ring member 180. Accordingly, the lock member 458 gradually moves from the lock position to the unlock position. When the tab 450 reaches the storing position, the engaging portion 458*a* is inserted into the depressed parts 470 of the ring member 180. Accordingly, the tab 450 is locked at the storing position by the lock member 458.

A similar advantageous effect to the embodiment described above can also be achieved by the fixed operating knob 428. The engaging portion 458*a* of the lock member 458 is inserted into the depressed parts 470 of the ring member 180. Accordingly, the engaging portion 458*a* engages with projecting portions between adjacent depressed parts 470 and prevents a rotation of the tab 450.

Specific embodiment of the present teachings is described above, but this merely illustrates some representative possibilities for utilizing the teachings and does not restrict the claims thereof. The subject matter set forth in the claims includes variations and modifications of the specific examples set forth above.

For example, the embodiment described above adopts a mechanism in which the tabs 50, 150, and 450 are locked by an engagement between the lock members 58, 158, and 458 and the tabs 50, 150, and 450 or the ring member 180. However, for example, the locking mechanism may involve locking the tabs 50, 150, and 450 to the storing position by a magnetic force.

In addition, the lock members 58, 158, and 458 need not be biased from the unlock position toward the lock position by the springs 64, 164, and 464.

A chain saw 10 comprising a fixed operating knob 28 that is a rotation knob and a oil cap 42 is described in the embodiment above. However, in addition to the chain saw 10, the rotation knob described in the present specification can be applied to various power tools such as a hedge cutter or a grass clipper, a hedge trimmer, a push mower, a grass cutter, and a bush cutter.

The technical elements disclosed in the specification or the drawings may be utilized separately or in all types of combinations, and are not limited to the combinations set forth in the claims at the time of filing of the application. Furthermore, the subject matter disclosed herein may be utilized to simultaneously achieve a plurality of objects or to only achieve one object.

The invention claimed is:

1. A power tool comprising:

a power tool body; and a rotation knob rotatably arranged on the power tool body and operated by a user, wherein the rotation knob comprises:

a knob body attached rotatably on the power tool body;

a tab attached on the knob body and capable of swinging between an operating position projecting from the knob body and a storing position stored in one of the knob body and the power tool body;

a tab spring biasing the tab toward the operating position; and a lock mechanism holding the tab at the storing position against the pressure of the tab spring in a case where the tab moves to the storing position.

2. The power tool as in claim 1, wherein the lock mechanism comprises a lock member arranged on one of the knob body and the tab, and the lock member is movably arranged between a lock position engaging with another of the knob body and the tab and an unlock position disengaging the other of the knob body and the tab in a state where the tab is located at the storing position.

3. The power tool as in claim 2, wherein the lock mechanism further comprises a lock spring biasing the lock member toward the lock position.

4. The power tool as in claim 2, wherein when the tab swings to the storing position and the lock member is capable of moving to the lock position, a surface of the tab opposes a surface of one of the knob body or the power tool body with a clearance, and the clearance becomes gradually larger as a distance from a swinging axis of the tab increases.

5. The power tool as in claim 1, further comprising:

a ring member fixed on the power tool body and surrounding the tab and the knob body, wherein a plurality of projecting portions is disposed on the ring member along a circumferential direction thereof, on at least one of an end surface located opposite from the power tool body and an inner surface, and the tab comprises an engaging portion that engages with at least one of the plurality of projecting portions when the tab is positioned at the storing position.

* * * * *